US007377862B2

(12) United States Patent
Galloway

(10) Patent No.: US 7,377,862 B2
(45) Date of Patent: May 27, 2008

(54) METHOD FOR FITTING A GOLF CLUB

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 11/868,857

(22) Filed: Oct. 8, 2007

(65) Prior Publication Data

US 2008/0026869 A1 Jan. 31, 2008

Related U.S. Application Data

(62) Division of application No. 10/711,112, filed on Aug. 24, 2004, now Pat. No. 7,281,985.

(51) Int. Cl.
*A63B 53/04* (2006.01)

(52) U.S. Cl. ..... 473/345; 473/409

(58) Field of Classification Search ..... 473/288, 473/305, 307, 345, 409
See application file for complete search history.

(56) References Cited

U.S. PATENT DOCUMENTS 4,804,184 A * 2/1989 Maltby ..... 473/409
4,872,685 A * 10/1989 Sun ..... 473/349
5,232,224 A * 8/1993 Zeider ..... 473/345
5,509,660 A * 4/1996 Elmer ..... 473/288
5,513,844 A * 5/1996 Ashcraft et al. ..... 473/288
5,851,155 A * 12/1998 Wood et al. ..... 473/246
5,906,549 A * 5/1999 Kubica ..... 473/314
5,951,411 A * 9/1999 Wood et al. ..... 473/307
6,332,847 B2 * 12/2001 Murphy et al. ..... 473/324
6,491,592 B2 * 12/2002 Cackett et al. ..... 473/342
6,575,843 B2 * 6/2003 McCabe ..... 473/245
6,645,086 B1 * 11/2003 Chen ..... 473/335
6,669,573 B2 * 12/2003 Wood et al. ..... 473/246
6,676,535 B2 * 1/2004 Sheets et al. ..... 473/328
6,769,994 B2 * 8/2004 Boone ..... 473/245
6,875,129 B2 * 4/2005 Erickson et al. ..... 473/345
2002/0091015 A1 * 7/2002 Seki et al. ..... 473/345
2003/0228933 A1 * 12/2003 Rice ..... 473/345
2004/0147343 A1 * 7/2004 Billings et al. ..... 473/349
2004/0152536 A1 * 8/2004 Solheim et al. ..... 473/305
2004/0229713 A1 * 11/2004 Helmstetter et al. ..... 473/342
2005/0009619 A1 * 1/2005 Boone ..... 473/287
2005/0026714 A1 * 2/2005 Stevens et al. ..... 473/329
2007/0022799 A1 * 2/2007 Latiri ..... 72/316
2007/0254746 A1 * 11/2007 Poynor ..... 473/309

* cited by examiner

*Primary Examiner*—Stephen Blau
(74) *Attorney, Agent, or Firm*—Michael A. Catania; Elaine H. Lo

(57) ABSTRACT

The golf club head (20) of the present invention allows for the face angle, lie angle, loft angle and shaft diameter of the golf club to be customized to a golfer. The golf club head (20) of the present invention is able to accomplish this by providing a major body (22) and a minor body (23) having a crown section (24) and hosel section (25). The minor bodies (23) have different hosel section (25) orientations thereby allowing for different face angles, loft angle, lie angles and shaft diameters of the golf club (19).

9 Claims, 11 Drawing Sheets

METHOD FOR FITTING A GOLF CLUB

CROSS REFERENCES TO RELATED APPLICATIONS

The Present Application is a divisional application of U.S. patent application Ser. No. 10/711,112, filed on Aug. 24, 2004 now U.S Pat. No. 7,281,985.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head with an upper section composed of a crown and hosel which is attached to a lower section composed of a striking plate, sole and ribbon.

2. Description of the Related Art

In order to improve their game, golfers seek customization of their equipment to their particular swing. Golf equipment manufacturers have responded by increasing the different types of clubs available to the average golfer. For drivers, this has included increasing the different number of lofts readily available to the average golfer. Further the average golfer can choose the type of shaft, whether metal or graphite, appropriate to the golfer's swing. Additionally, the length of the shaft may be adjusted, and the type of grip can be customized for the golfer.

However, golfers demand perfection, and every possible adjustment must be made to fit a particular golfer's swing. Thus, drivers that allow for adjustments in the lie angle and face angle have been made available to golfers. One such driver is Jackson, U.S. Pat. No. 5,839,973 for a Golf Club Head With Enlarged Hosel, originally filed in 1996. The insert of Jackson is removable thereby allowing for another insert with a different shaft orientation to be inserted into the hosel. The insert of Jackson has a diameter that is much larger than that of the tip end of the shaft.

Another example is Schroder, U.S. Pat. No. 5,197,733, filed in 1990 for a Golf Club. The Schroder patent discloses a club head with an elongated lower shaft portion that can be rotated to adjust the face angle of the golf club. The lower shaft portion is adjustable by rotating the shaft to accommodate the golfer, however, the tip of the shaft will be disposed behind or in proximity to the center of percussion of the golf club. Additionally, Schroder requires a particular shaft, with a lower angled portion, for the golf club head.

A further example is Toulon, U.S. Pat. No. 5,626,528, filed in 1996, for a Golf Club Head And Hosel Construction. The Toulon patent discloses a hosel with a slot groove that provides for adjustment of the face angle by five degrees and the lie angle by seven degrees by application of a transverse bending force on the hosel.

A further example of such an invention is Wood, et al., U.S. Pat. No. 5,851,155, which was originally filed in 1997. The Wood patent discloses a hosel that allows for customization of the face angle for a particular golfer by reorienting the club head relative to a neck member of the hosel.

Yet a further example is Kubica, U.S. Pat. No. 5,906,549 which was filed in 1997 for a golf club and a multitude of hosels with each hosel having a passage with a different angle relative to the club head. Each hosel has a flat portion for securing the hosel within a bore in the club head. In order to adjust the angle, the hosel must be replaced with another hosel. The hosels are composed of a material softer than the club head.

The prior art also contains the use of inserts for non-adjustment purposes. One example of the prior art is Chappell, U.S. Pat. No. 5,688,188 for a golf club. The Chappell patent discloses an iron with a ferrule composed of a thermoplastic material having a modulus of elasticity of 80-1980 pounds per square inch, a specific gravity of 1.15 to 1.22, shore hardness of 60, and an Izod strength of 3.0 to 10.0 ft/lbs. The ferrule is placed within an external hosel, and the exposed end of the ferrule 21 millimeters. The preferred material is a butyrate.

Another example is Dekura, U.S. Pat. No. 5,766,089, which was originally filed in Japan in 1994 for a metal wood composed of magnesium or aluminum alloy with a hosel attaching section composed of ABS and epoxy. The rigidity of the hosel attaching section is lower than the shaft to absorb vibration and shock to thereby reduce vibrations through the shaft.

Another example is Take et al., U.S. Pat. No. 5,575,723, originally filed in Japan in 1994 for a Golf club With Cushion Material Between Shaft And Head. The Take patent discloses the use of a cushioning member composed of a synthetic resin such as ABS resin, polycarbonate, or epoxy, in order to cushion the shaft within the metal head.

Another example is Allen, U.S. Pat. No. 5,888,149 which was originally filed in 1999 for a shortened hosel and an extended ferrule. The primary object of the Allen patent is to reduce hosel weight without sacrificing shaft support or cosmetic integrity. The Allen patent discloses a hosel with a length of 0.625 inch to 0.750 inch, and an extended ferrule composed of a high strength thermoplastic.

One of the earliest examples is Offutt, U.S. Pat. No. 1,167,922, originally filed in 1914 for a golf club head with an enlargement on a tubular metal shaft to provide a fluted surface.

Still another example is Wood, et al., U.S. Pat. No. 5,951,411, which was originally filed in 1998 for a golf club head and a hosel coupling assembly. The Wood patent discloses a hosel that allows for customization of the face angle for a particular golfer by reorienting the club head relative to a coupling assembly.

Another example is Jackson, U.S. Pat. No. 6,251,028, which was originally filed in 1998 for a golf club with enlarged hosel and curved sole plate. The hosel is hollow, wherein the hollow interior of the hosel is substantially larger than the mounting end of the shaft so the face angle can be modified by changing the orientation of the shaft to the hosel.

Yet another example is McCabe, U.S. Pat. No. 6,575,843 which was originally filed in 2001 for a golf club with a selectable loft and lie angulation. The hosel of McCabe is removable and interchangeable thereby allowing for another hosel with a different shaft orientation to be inserted into a hosel receiving tube.

However, golfers want a high performance golf club that can be easily customized to them while golf equipment manufacturers need to provide as much standardization as possible in order to prevent escalation of manufacturing costs. Thus, although the prior art has presented many inventions for providing customization, the prior art has failed to provide a cost effective method of customization.

BRIEF SUMMARY OF THE INVENTION

The present invention provides a solution to the cost-effective customization of golf clubs while provide golfers with golf clubs that they currently play and trust to give them optimal performance. The present invention is able to accomplish this by providing a wood-type golf club head with an insert for orientation of the golf club face angle subsequent to the manufacturing of the golf club head.

A golf club head is typically manufactured using a casting procedure or a forging procedure. Typically, the face angle of the golf club is fixed at the time of manufacture since the location and orientation of the hosel is integrally manufactured with the entirety of the golf club head. Depending on manufacturing tolerances, the intended face angle, or effective loft angle, could be off several degrees or more. The present invention overcomes these problems by fixing the face angle of the golf club post-manufacturing through use of an insert.

One aspect of the present invention is a golf club including a golf club head, an insert and a shaft. The golf club head has a crown portion with an internal hosel and a main body with a sole and a striking plate. The internal hosel has a hosel wall defining a bore that extends from a crown opening below a top of the crown to a sole opening at the sole. The insert is disposed within the internal hosel. The insert has a cylindrical body that extends from the crown opening to a sole hosel. The cylindrical body defines a bore that extends from the crown opening. The bore is disposed at a predetermined angle within the cylindrical body to define a face angle of the golf club. The shaft has a tip end and a butt end. The tip end of the shaft is positioned through the bore of the insert to the sole opening.

Another aspect of the present invention is a method for manufacturing a golf club. The method begins with providing a golf club head having a crown portion with an internal portion extending from the crown and a main body with a sole and a striking plate. The internal hosel has a hosel wall defining a bore that extends from a crown opening below a top of the crown. The next step is selecting a crown portion with an internal hosel with the properties orienting the face angle of the golf club. The next step is attaching the crown to the main body. The next step is attaching a removable insert to a tip end of a shaft. The insert has a cylindrical body that defines a bore extending therethrough. The shaft is positioned within the bore. The next step is placing the shaft, while attached to the insert, within the internal hosel of the golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
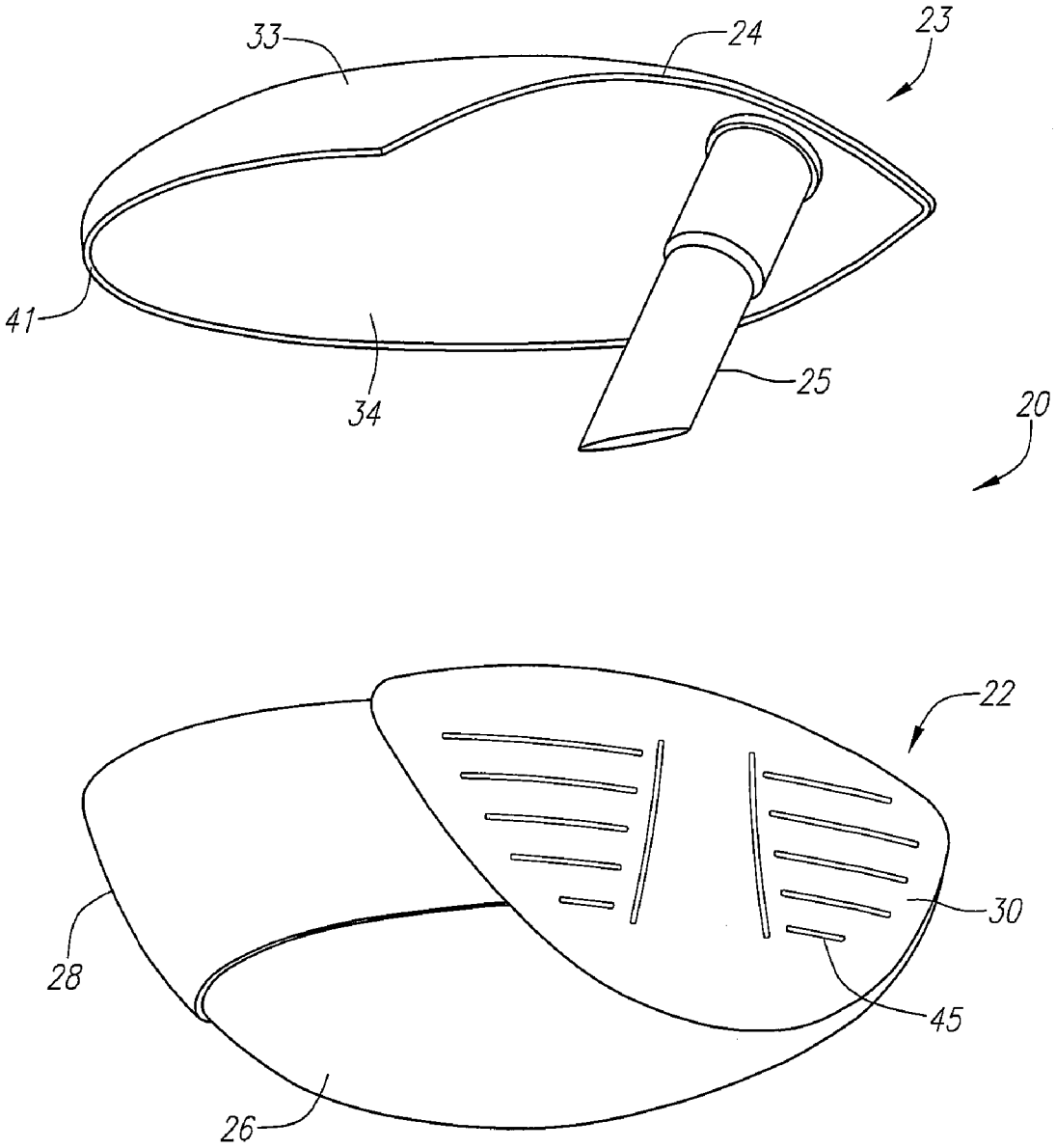
FIG. 1 is an exploded perspective view of the golf club head of the preferred embodiment of the present invention.

As shown in FIGS. 1-7, a golf club head is generally designated 20. The golf club head 20 is generally composed of two components, a major body 22 and a minor body 23. The major body 22 preferably includes a sole section 26, a ribbon section 28 and a striking plate section 30. The ribbon generally extends from a heel end 36 to an aft end 37 to a toe end 38 of the golf club head 20. The aft end 37 of the golf club head 20 is opposite the striking plate section 30. The major body 22 is preferably composed of a metal material such as titanium alloy, titanium, steel, steel alloy, aluminum, aluminum alloy, magnesium, magnesium alloy, tin, brass, tungsten based alloys, and amorphous metal. In a preferred embodiment, the major body 22 is cast of a metal material, most preferably a titanium alloy such as 6-4 titanium alloy, alpha-beta titanium alloy or beta titanium alloy. Alternatively, the major body 22 is composed of 17-4 steel alloy. Additional methods for manufacturing the major body 22 include forming the major body 22 from a flat sheet of metal, super-plastic forming the major body 22 from a flat sheet of metal, machining the major body 22 from a solid block of metal, electrochemical milling the body from a forged pre-form, casting the body using centrifugal.

In a preferred embodiment, the striking plate section 30 has an uniform thickness that ranges from 0.040 inch to 0.250 inch, more preferably a thickness of 0.080 inch to 0.120 inch, and is most preferably 0.108 inch. Other alternative embodiments of the thickness of the striking plate section 30 are disclosed in U.S. Pat. No. 6,471,603, for a Contoured Golf Club Face and U.S. Pat. No. 6,398,666 for a Golf Club Striking Plate With Variable Thickness, which are both owned by Callaway Golf Company and which pertinent parts are hereby incorporated by reference. The striking plate section 30 preferably has a plurality of score-lines 45 thereon.

The minor body 23 preferably includes a crown section 24 and a hosel section 25. The minor body 23 is preferably composed of a light-weight material, relative to the mass of the major body 22. Such light-weight materials include thermoplastic polymers, thermosetting polymers, aluminum, aluminum alloys, magnesium, magnesium alloys, tin, brass and copper. The minor body 23 is preferably composed of a material having a density less than 5.0 grams per cubic centimeter ("g/cc"), and more preferably less than 1.5 g/cc. Preferred thermoplastic polymers include thermoplastic polyurethanes, ionomers, polyamides and polycarbonates.

Preferred thermosetting polymers include thermosetting polyurethanes and polybutadienes. A most preferred material for the minor body 23 is a polycarbonate material. Exemplary magnesium alloys for the minor body 23 are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese).

Figure 16:
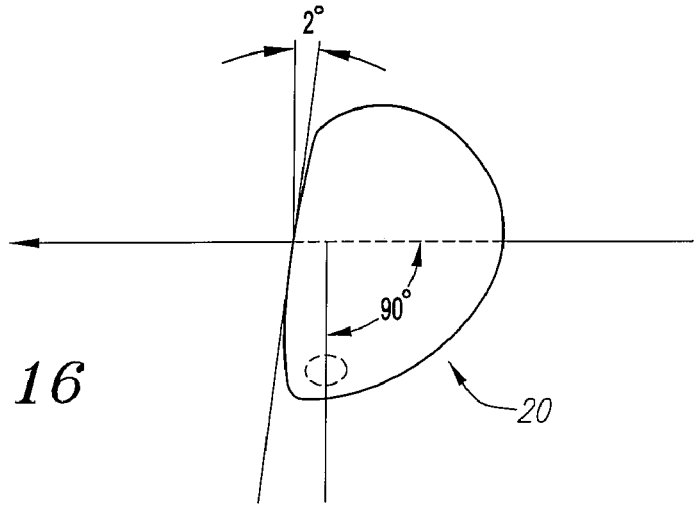
FIG. 16 is a top plan view of a golf club head with an open face angle.
Figure 17:
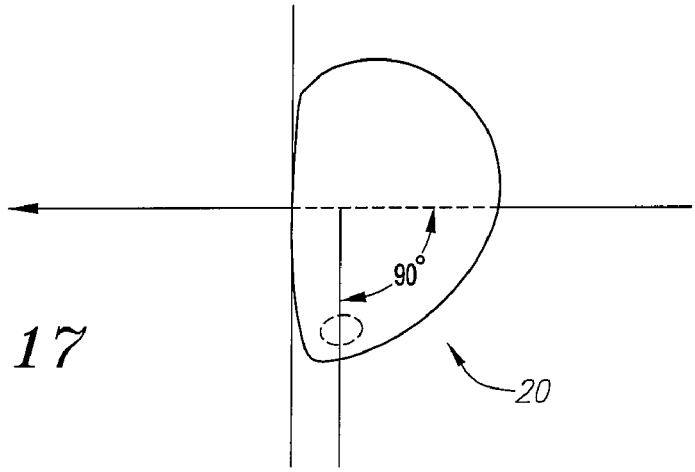
FIG. 17 is a top plan view of a golf club head with a square face angle.
Figure 18:
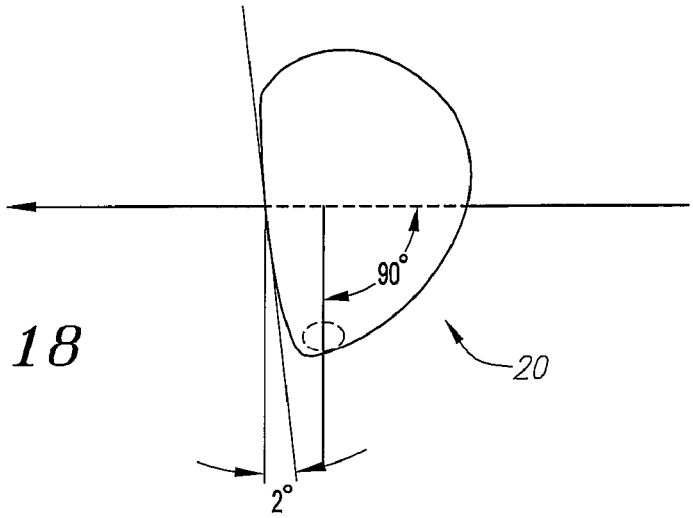
FIG. 18 is a top plan view of a golf club head with a closed face angle.
Figure 19:
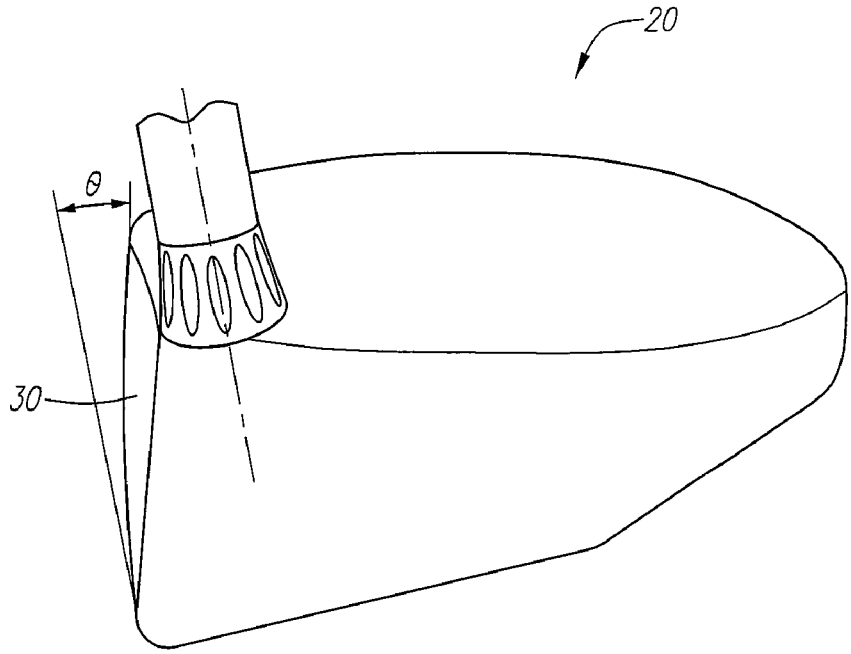
FIG. 19 is a heel side view of a golf club illustrating the loft angle of the golf club.

The hosel section 25 is oriented relative to the crown section 24 to preferably control a face angle, a lie angle and a loft angle of a golf club 19. The lie angle, $\alpha$, of a golf club is typically defined as the angle of the shaft's centerline with a line tangent to the sole at the center of the face. The face angle of a golf club is typically defined as the angle of the face of the golf club to a grounded sole center line. FIGS. 16-18 illustrate various face angles of club heads 20. The loft angle is typically defined as the angle of the face of a golf club to a line perpendicular to a grounded sole center line. FIG. 19 illustrates the loft angle, $\theta$, for a golf club. In an alternative embodiment, the hosel section 25 is attachable to the crown section 24.

Figure 14:
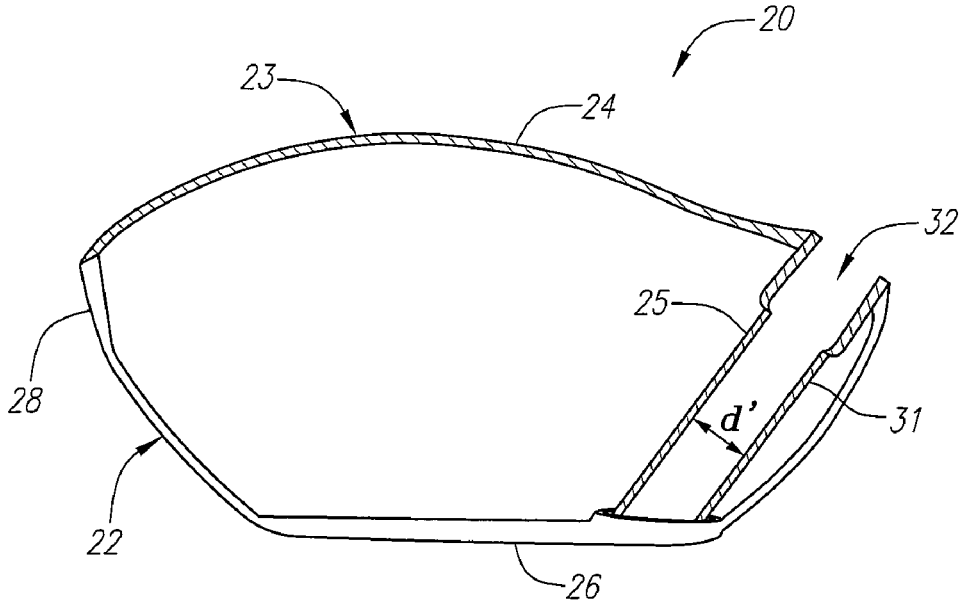
FIG. 14 is a cross-sectional view along line 14-14 of FIG. 3.
Figure 15:
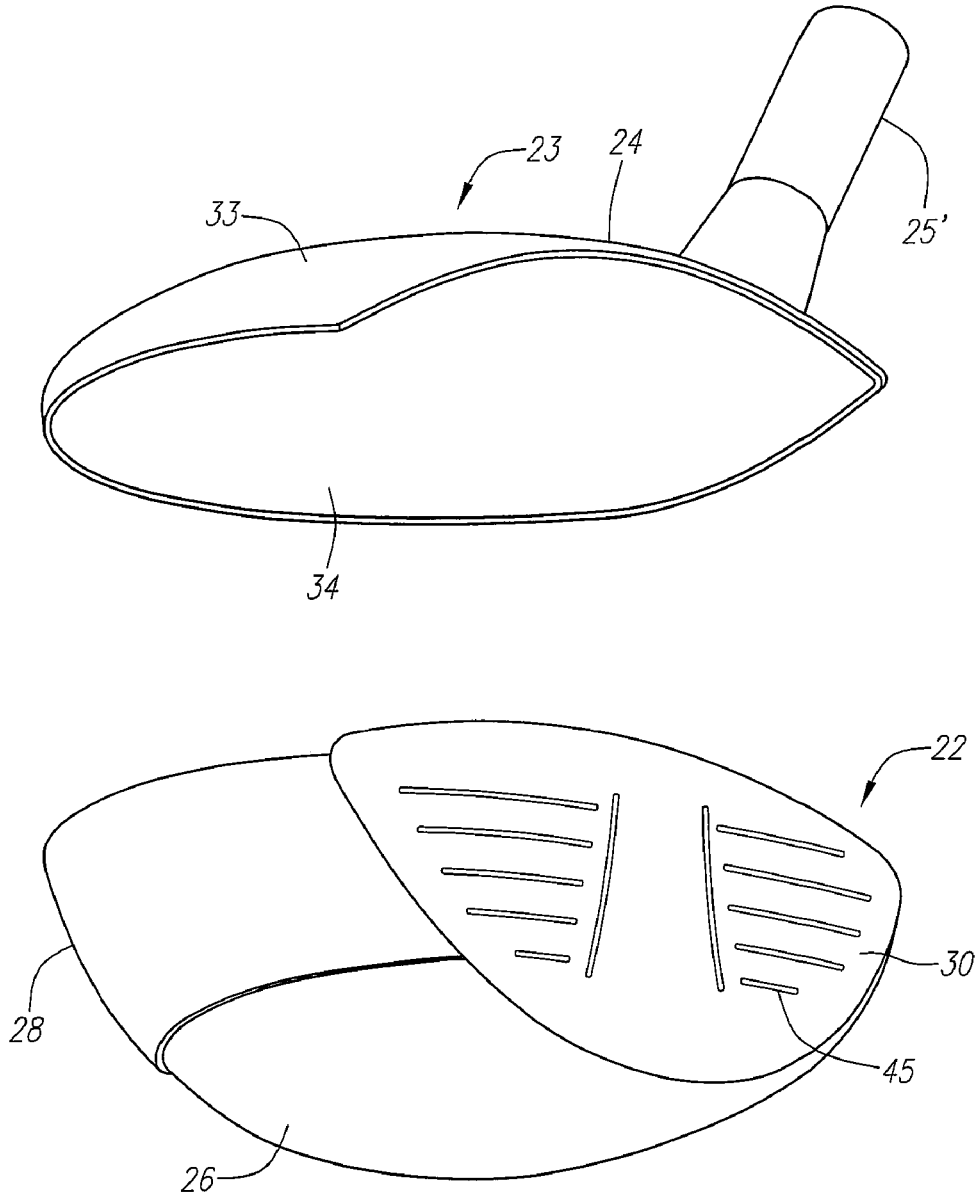
FIG. 15 is an exploded perspective view of the golf club head of an alternative embodiment of the present invention.

As shown in FIG. 14, the hosel section 25 generally includes a hosel wall 31, which defines a hosel bore 32. The hosel bore 32 is accessed through opening 42. In a preferred embodiment, the hosel section 25 extends downward from an interior surface 34 of the crown section 24. The diameter, "d", of the hosel bore 32 is typically sized to accommodate a tip end of a shaft 77. The shaft tip diameter is typically 0.035 inch. Alternatively, a "fat shaft", having a large tip diameter may be utilized. Such a large tip diameter shaft is disclosed in U.S. Pat. No. 5,093,162, for a Large-Tip Composite Golf Shaft, assigned to Callaway Golf Company, and hereby incorporated in its entirety by reference. In an alternative embodiment, such as shown in FIG. 15, the hosel section 25' extends upward from an exterior surface 33 of the crown section 24.

Figure 8:
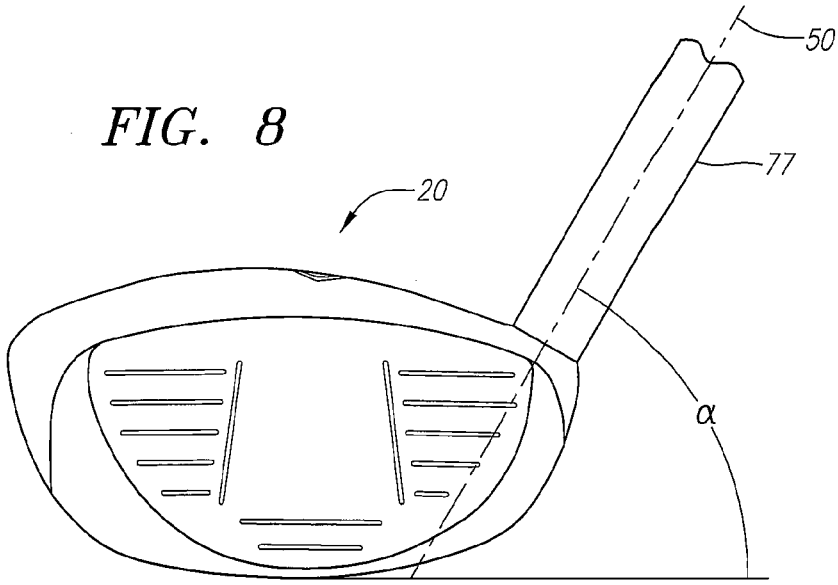
FIG. 8 is a front plan view of the golf club with a first lie angle of the golf club.
Figure 10:
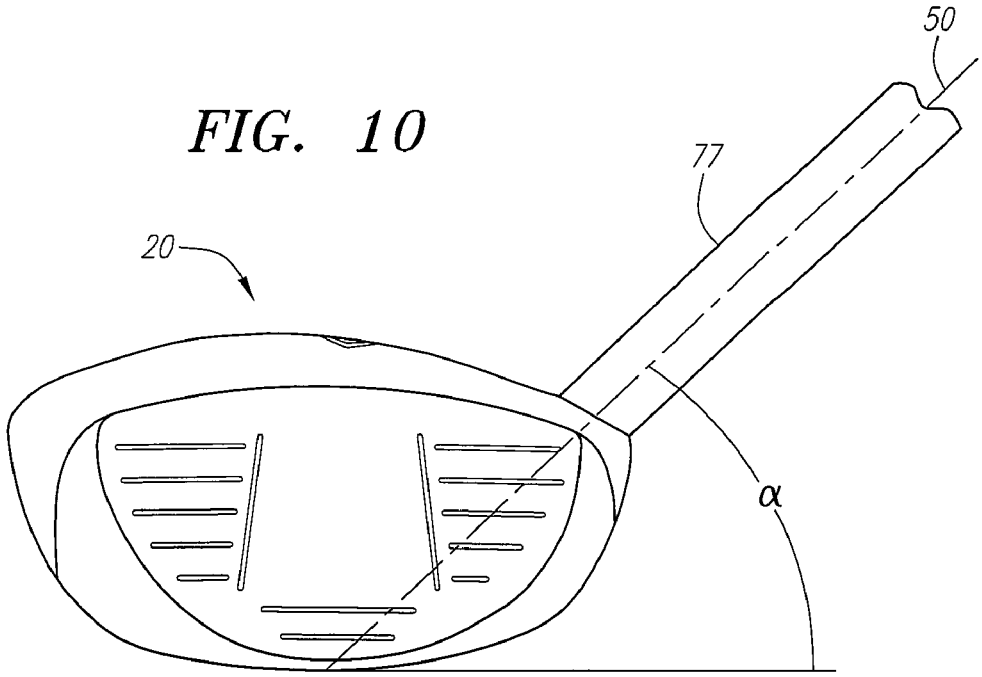
FIG. 10 is a front plan view of the golf club with a second lie angle of the golf club.
Figure 11:
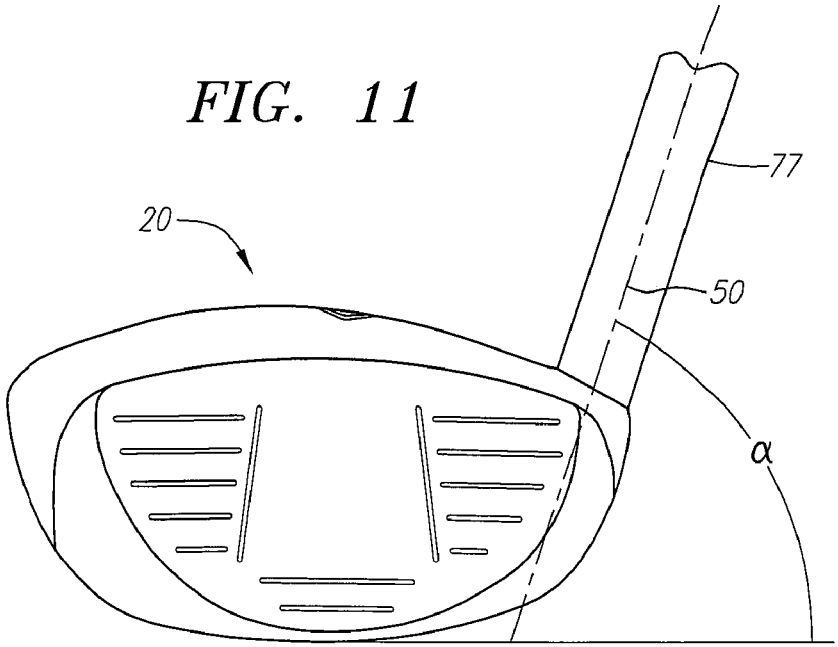
FIG. 11 is a front plan view of the golf club with a third lie angle of the golf club.

The present invention allows for a number of different club heads to have the same major body 22 while varying the minor body 23. As shown in FIGS. 8, 10 and 11, golf clubs 19 having different lie angles will use the same major body 22 while varying the minor body 23. Further, the present invention allows for the loft angle, face angle and hosel diameter to vary while utilizing the same major body 22.

In a preferred embodiment, an edge 41 of the minor body 23 is adhered to an edge 40 of the major body 22 using an adhesive, thereby covering an open cavity 35 of the major body 22 defined by the sole section 26, the ribbon section 28 and the striking plate section 30. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

Figure 9:
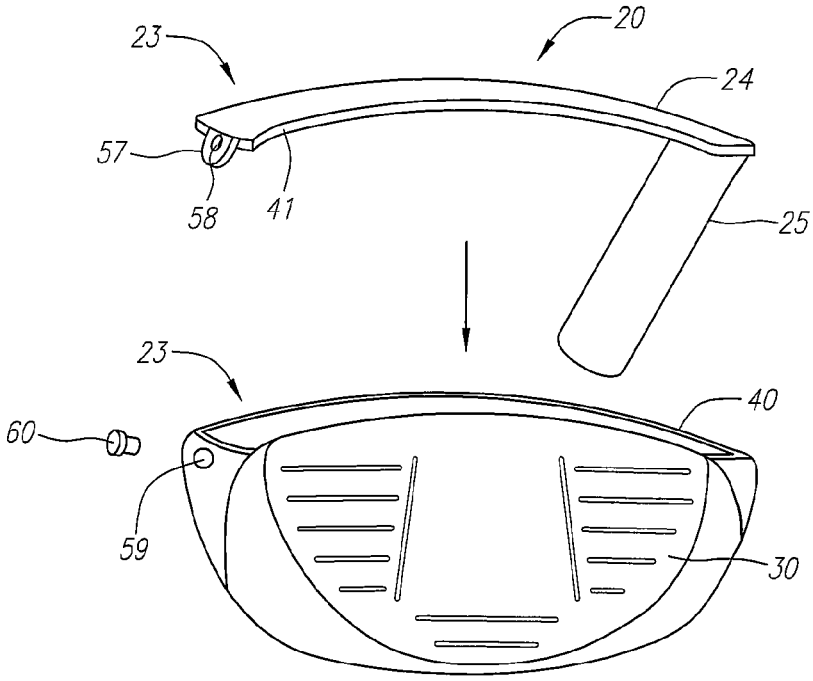
FIG. 9 is an exploded front plan view of a golf club head.

In an alternative embodiment, such as shown in FIG. 9, the minor body 23 has a plurality of tabs 57 extending downward form the crown section 24. Each of the plurality of tabs preferably has a threaded bore 58 for receiving a screw 60 threaded though a bore 59 in the ribbon section 28 of the major body 22. In this manner, the present invention may be used to fit a golf club with a lie angle, loft angle, face angle and/or hosel diameter selected to match a golfer's ball striking parameters. Such ball striking parameters are disclosed in U.S. Pat. No. 6,431,990 for a System And Method For Measuring A Golfer's Ball Striking Parameters, assigned to Callaway Golf Company, and which is hereby incorporated by reference in its entirety.

Figure 12:
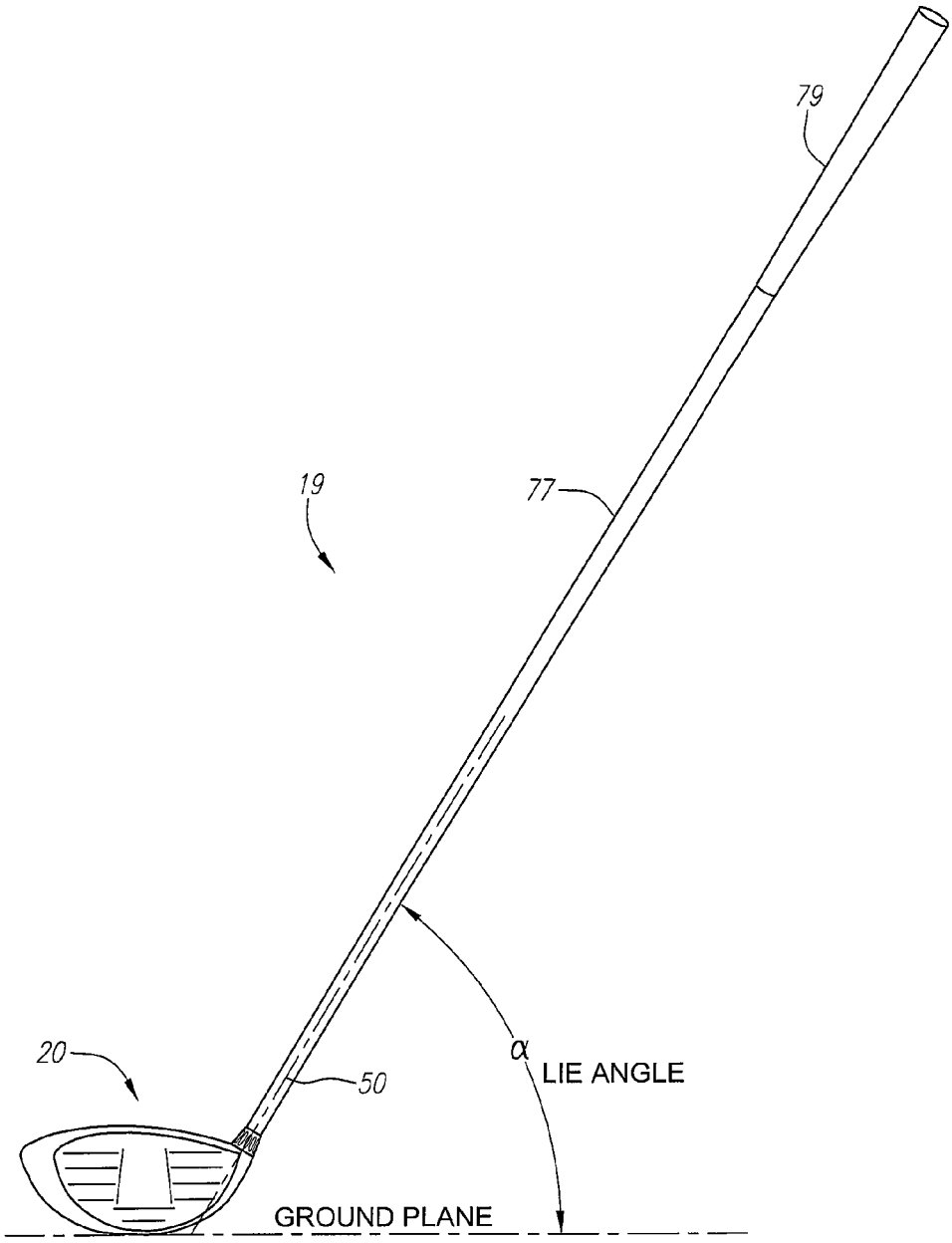
FIG. 12 is a front plan view of a golf club.
Figure 13:
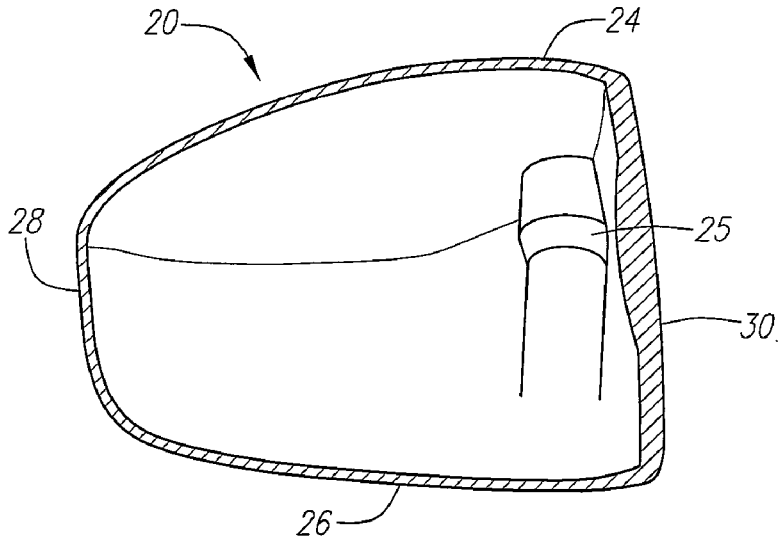
FIG. 13 is a cross-sectional view along line 13-13 of FIG. 3.

FIG. 12 illustrates the lie angle of a golf club 19 with a golf club head 20 having a shaft 77 inserted into the hosel section 25, not shown, at a tip end of the shaft 77. A butt end of the shaft has a grip 79 thereon.

The golf club head 20, when designed as a driver, preferably has a volume from 200 cubic centimeters to 600 cubic centimeters, more preferably from 250 cubic centimeters to 460 cubic centimeters, and most preferably from 350 cubic centimeters to 420 cubic centimeters. A golf club head 20 for a driver with a body 22 composed of a cast titanium alloy most preferably has a volume of 415 cubic centimeters. The volume of the golf club head 20 will also vary between fairway woods (preferably ranging from 3-woods to eleven woods) with smaller volumes than drivers.

Figure 2:
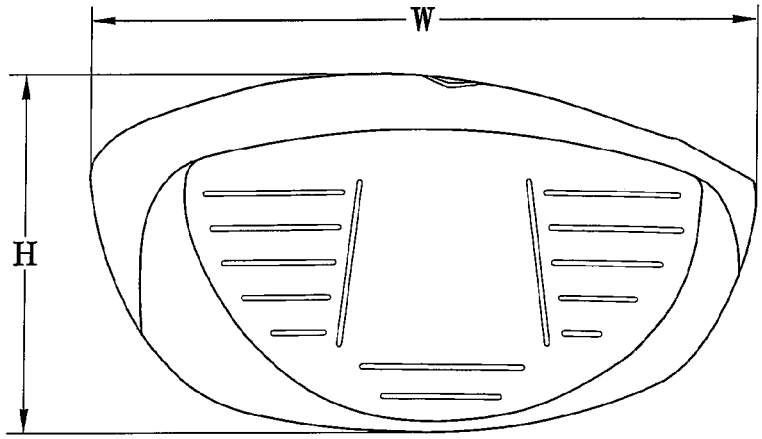
FIG. 2 is a front plan view of the golf club head of the preferred embodiment of the present invention.
Figure 3:
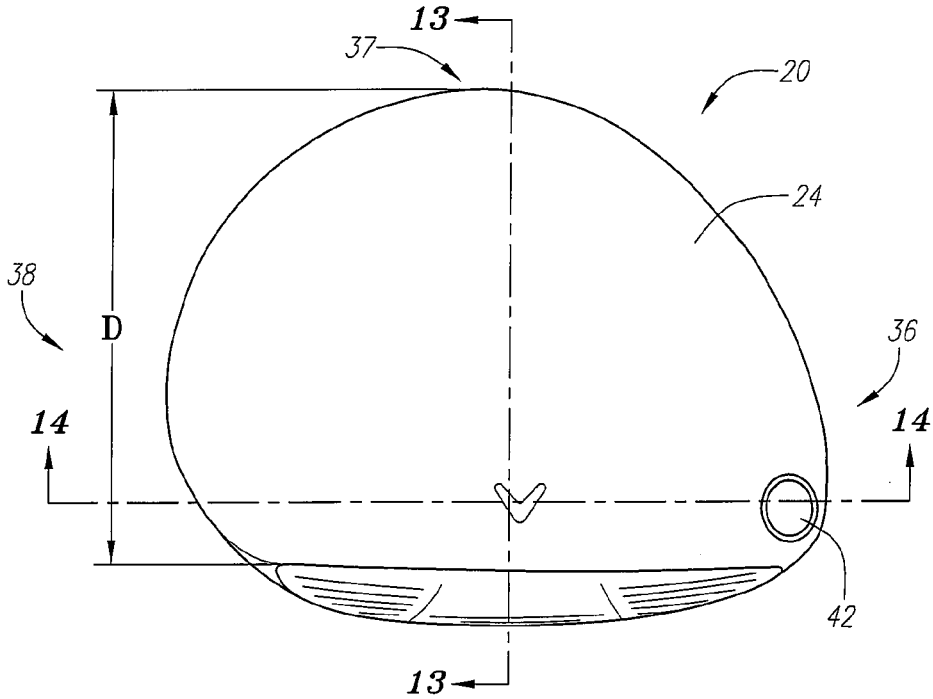
FIG. 3 is a top plan view of the golf club head of FIG. 2.
Figure 4:
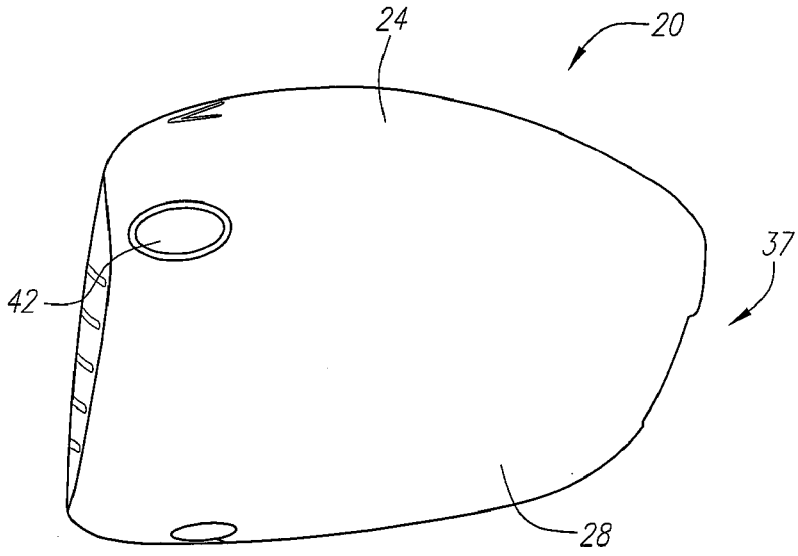
FIG. 4 is a heel end side view of the golf club head of FIG. 2.
Figure 5:
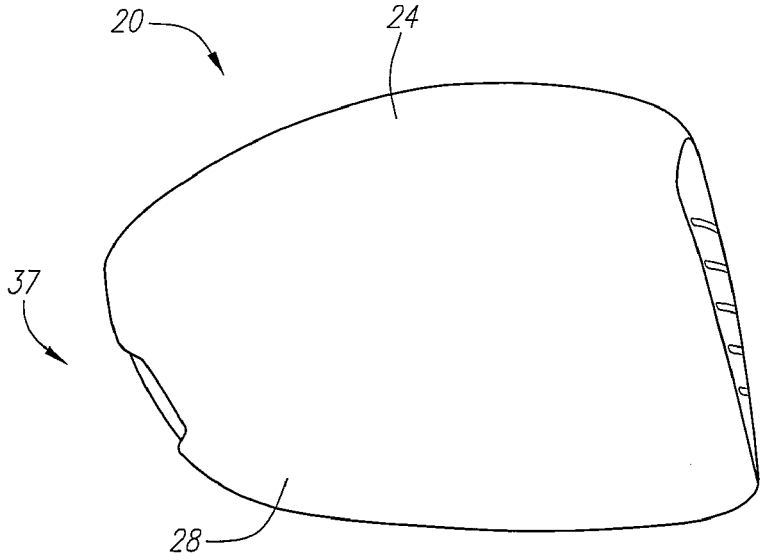
FIG. 5 is a toe side view of the golf club head of FIG. 2.
Figure 6:
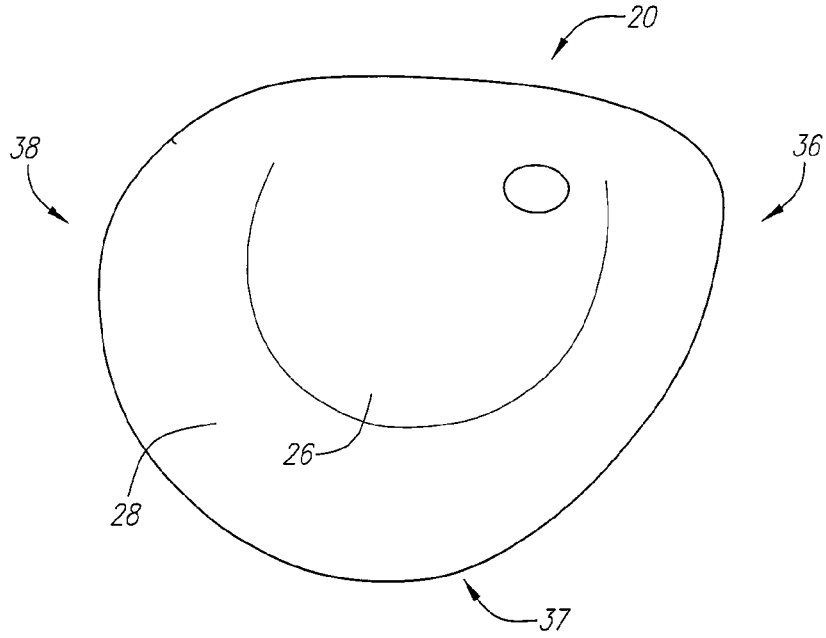
FIG. 6 is a bottom plan view of the golf club head of FIG. 2.
Figure 7:
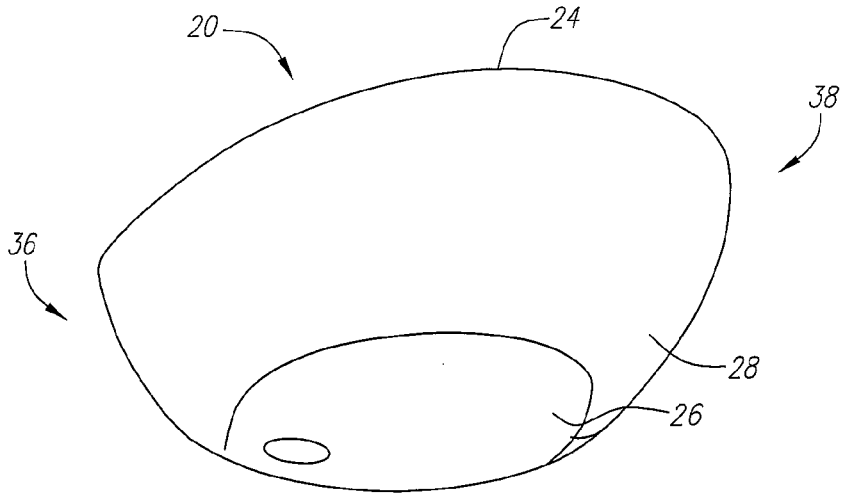
FIG. 7 is a bottom perspective view of the golf club head of FIG. 2.

As shown in FIG. 3, the depth of the club head 20 from the striking plate section 30 to the aft-end 37 preferably ranges from 3.0 inches to 4.5 inches, and is most preferably 3.75 inches. As shown in FIG. 2, the height, "H", of the club head 20, as measured while in address position, preferably ranges from 2.0 inches to 3.5 inches, and is most preferably 2.50 inches or 2.9 inches. As shown in FIG. 2, the width, "W", of the club head 20 from the toe end 38 to the heel end 36 preferably ranges from 4.0 inches to 5.0 inches, and more preferably 4.7 inches.

The center of gravity and the moments of inertia of the golf club head 20 may be calculated as disclosed in U.S. Pat. No. 6,607,452, entitled High Moment Of Inertia Composite Golf Club, and hereby incorporated by reference in its entirety. In general, the moment of inertia, Izz, about the Z axis for the golf club head 20 will preferably range from 2700 g-cm$^2$ to 5500 g-cm$^2$, more preferably from 3000 g-cm$^2$ to 4800 g-cm$^2$. The moment of inertia, Iyy, about the Y axis for the golf club head 20 will preferably range from 1500 g-cm$^2$ to 5000 g-cm$^2$, although alternative embodiments can have a higher moment of inertia, Iyy, about the Y axis.

The present invention is directed at a golf club head that has a high coefficient of restitution thereby enabling for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution preferably ranging from 0.81 to 0.94, as measured under conventional test conditions.

The mass of the club head 20 preferably ranges from 165 grams to 300 grams, more preferably ranges from 175 grams to 230 grams, and most preferably from 195 grams to 225 grams. Preferably, the major body 22 has a mass ranging from 140 grams to 200 grams, more preferably ranging from 150 grams to 180 grams, yet more preferably from 155 grams to 166 grams, and most preferably 161 grams. The minor body 22 preferably has a mass ranging from 10 grams to 100 grams, more preferably from 25 grams to 75 grams, and most preferably 50 grams. Additionally, epoxy, or other like flowable materials, in an amount ranging from 0.5 grams to 5 grams, may be injected into the hollow interior of the golf club head 20 for selective weighting thereof.

In general, the golf club head 20 has products of inertia such as disclosed in U.S. Pat. No. 6,425,832, and is hereby incorporated by reference in its entirety. Preferably, each of the products of inertia, Ixy, Ixz and Iyz, of the golf club head 20 have an absolute value less than 100 grams-centimeter squared. Alternatively, the golf club head 20 has a at least one or two products of inertia, Ixy, Ixz and Iyz, with an absolute value less than 100 grams-centimeter squared.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A method for fitting a golf club to a golfer's swing parameters, the method comprising:

determining the golfer's optimum loft angle, lie angle and face angle of a golf club;

providing a major body of a golf club head comprising a sole section with a hosel insertion hole, a striking plate section and a ribbon;

selecting a minor body of a golf club head from a plurality of minor bodies, each of the minor bodies comprising a crown section and a hosel section, the hosel section of each of the plurality of minor bodies having a different orientation relative to the crown section, the hosel section oriented relative to the crown section to determine the loft angle, the lie angle and the face angle of the golf club head, the selected minor body corresponding to the golfer's optimum loft angle, lie angle and face angle of a golf club;

attaching the minor body to the major body to form a substantially hollow golf club head wherein a tip end of said hosel section is inserted into said hosel insertion hole of said sole section; and attaching a shaft to the golf club head to form a golf club with the golfer's optimum loft angle, lie angle and face angle.

2. The method according to claim 1 wherein the major body is composed of a metal material and the minor body is composed of a non-metal material.

3. The method according to claim 1 wherein the crown section has an exterior surface and an interior surface, and the hosel section extends downward from the interior surface of the crown section.

4. The method according to claim 1 wherein the crown section has a thickness ranging from 0.020 inch to 0.150 inch.

5. The method according to claim 1 wherein the minor body is composed of a material selected from the group consisting of polycarbonate, plies of pre-preg, polyurethane, polyamide, ionomer and polybutadiene.

6. The method according to claim 1 wherein the major body is composed of a metal selected from the group consisting of titanium, titanium alloy, steel, steel alloys, magnesium, magnesium alloys, aluminum and aluminum alloys.

7. The method according to claim 1 wherein the major body has a mass ranging from 100 grams to 200 grams, and the minor body has a mass ranging from 20 grams to 100 grams.

8. The method according to claim 1 wherein the golf club head has a volume ranging from 300 cubic centimeters to 500 cubic centimeters.

9. A method for fitting a golf club to a golfer's swing parameters, the method comprising:

determining the golfer's optimum loft angle, lie angle and face angle of a golf club;

providing a major body of a golf club head comprising a sole section with a hosel insertion hole, a striking plate section and a ribbon, the major body composed of a metal material, the major body having a plurality of apertures with threaded bores;

selecting a minor body of a golf club head from a plurality of minor bodies, each of the minor bodies comprising a crown section with a thickness ranging from 0.020 inch to 0.150 inch, a hosel section and a plurality of tabs extending downward, each of the plurality of tabs having a threaded bore and aligned with an aperture of the plurality of apertures of the major body, the hosel section of each of the plurality of minor bodies having a different orientation relative to the crown section, the hosel section oriented relative to the crown section to determine the loft angle, the lie angle and the face angle of the golf club head, the selected minor body corresponding to the golfer's optimum loft angle, lie angle and face angle of a golf club;

attaching the minor body to the major body to form a substantially hollow golf club head wherein a tip end of said hosel section is inserted into said hosel insertion hole of said sole section; and attaching a shaft to the golf club head to form a golf club with the golfer's optimum loft angle, lie angle and face angle.

* * * * *